US005993336A

United States Patent [19]

Repper et al.

[11] Patent Number: 5,993,336

[45] Date of Patent: Nov. 30, 1999

[54] METHOD OF EXECUTING A TENNIS STROKE

[76] Inventors: Kevin M. Repper; George R. Repper, both of 2903 Dadmun Ct., Fairfax, Va. 22031

[21] Appl. No.: 09/050,373

[22] Filed: Mar. 31, 1998

[51] Int. Cl.[6] ..... A63B 49/00

[52] U.S. Cl. ..... 473/516

[58] Field of Search ..... 473/422, 459, 473/464, 516; 2/24

[56] References Cited

U.S. PATENT DOCUMENTS

| | | | |
|---|---|---|---|
| 2,805,420 | 9/1957 | Spellos | 2/24 |
| 3,346,877 | 10/1967 | Zirves | 2/24 |
| 4,084,584 | 4/1978 | Detty | 2/24 X |
| 5,255,391 | 10/1993 | Levine | 2/24 |

OTHER PUBLICATIONS

"Use Court Landmarks for More Control" by Peter Burwash, Tennis Magazine, pp. 46–47, Feb. 1997.

Paul Douglas, "The Handbook of Tennis", New York: Alfred A. Knopf 1995, pp. 28–29, 46–47, 162–163 and 218–219.

*Primary Examiner*—Raleigh W. Chiu

*Attorney, Agent, or Firm*—Rothwell, Figg, Ernst & Kurz, p.c.

[57] ABSTRACT

A method of executing a tennis stroke includes covering a knee of a tennis player with a knee pad during tennis play. The covered knee of the player is placed on a tennis court surface with the knee pad positioned between the knee and the surface. The tennis racket is swung toward a tennis ball so as to hit the tennis ball with the racket either while the covered knee is on the tennis court surface, or just prior to the knee contacting the tennis court surface.

16 Claims, No Drawings

METHOD OF EXECUTING A TENNIS STROKE

BACKGROUND OF THE INVENTION

1. Field of the Invention

The present invention relates to the field of playing tennis.

2. Description of the Background Art

Tennis is a well known game which is played on a tennis court having a surface centrally divided by a vertical net. Each player has a racket and generally plays bare-legged, with men players typically wearing short pants and women players often wearing skirts or short pants.

During the game of tennis, players hit the ball over the net with the racket. One object of the game is to hit the ball over the net so that the ball lands in-bounds in the opponent's court, but at a location out of effective stroking reach of the opponent, whereby the opponent cannot successfully execute a stroke to return the ball in-bounds.

There remains a need in the art for improved methods of executing tennis strokes in difficult ball-return situations.

SUMMARY OF THE INVENTION

In accordance with the present invention, a method of executing a tennis stroke comprises covering a knee of a tennis player with a knee pad during tennis play. The covered knee of the player is placed on a tennis court surface with the knee pad positioned between the knee and the surface. The tennis racket is swung toward a tennis ball so as to hit the tennis ball with the racket either while the covered knee is on the tennis court surface or just prior to the knee contacting the surface.

DETAILED DESCRIPTION OF THE INVENTION

The present invention provides a method for executing a tennis stroke so that balls can be successfully returned during tennis play in otherwise difficult-to-reach situations.

The method includes the step of covering a knee of a tennis player with a knee pad during tennis play. The knee pad can be any suitable knee pad such as those used for in-line skating, skateboarding and the like. In certain embodiments, the knee pad is formed only of padding material which covers the entire knee area including the knee-cap, or at least a substantial portion of the knee area. In other embodiments, the knee pad includes padding material for covering the knee, with the padding material being at least partly covered by an outer hard shield made of plastic or other protective material.

During tennis play, the tennis player holds a tennis racket with at least one arm, such as during a forehand stroke, or optionally with two arms during a two-handed stroke such as a backhand stroke. However, backhand strokes also can be one-armed strokes.

During the method of the present invention, the covered knee of the player is placed on the tennis court surface with the knee pad positioned between the player's knee and the tennis court surface so as to protect the player's knee during execution of the stroke.

In accordance with one embodiment, the stroke is executed and the ball is hit during the placing step but prior to the knee actually contacting the court surface.

However, in particularly preferred embodiments, the ball is hit with the racket while the covered knee is on the tennis court surface. This provides a particularly stable platform for hitting the ball in difficult-to-reach situations. In preferred embodiments, the torso portion of the player is substantially upright (perpendicular) with respect to the tennis court surface when the ball is hit.

The method of the present invention can be utilized for executing both forehand and backhand strokes. In accordance with one embodiment, the covering step is carried out on first and second knees, i.e., both knees, of the player.

However, the present invention is especially useful for executing forehand strokes, and particularly useful for executing forehand strokes utilizing a knee pad-covered knee corresponding to the forehand arm being used. In accordance with this embodiment, the covering step is selected from the group consisting of covering a right knee of a right-handed player and covering a left knee of a left-handed player. According to this embodiment, a right-handed player has a knee pad-covered right knee for executing a forearm swing.

In particularly preferred embodiments, the right-handed player places the knee pad-covered right knee on the tennis court surface and hits the ball with a forearm stroke, with the right and left feet of the tennis player in contact with the tennis court surface, but with the left knee of the tennis player out of contact with and above the tennis court surface. This provides a particularly stable platform for executing a forearm swing, while permitting the player to quickly get back on two feet, in position to chase down a returned ball.

A preferred forearm stance for a left-handed player is just the opposite of that described for a right-handed player, i.e., the left-handed player executes a forearm stroke with a knee pad-covered left knee and both feet contacting the court surface, but with the right knee out of contact with and above the court surface.

However, a tennis stroke in accordance with the present invention can be carried out with the opposite knee of a stroke contacting the court surface, e.g., a right-handed player executing a forearm stroke with a knee pad-covered left knee on the court surface, a right-handed player executing a backhand stroke with a knee pad-covered right knee on the tennis court surface, etc.

Alternatively, both forehand and backhand strokes can be carried out with both knee pad-covered knees in contact with the tennis court surface.

The present invention provides a method for executing a tennis stroke which enables a player to successfully return balls that otherwise are out of effective stroking reach.

We claim:

1. A method of using a tennis racket during tennis play so as to execute a tennis forehand stroke, comprising:

covering a first knee of a tennis player with a knee pad during tennis play, said tennis player having a second knee and two feet, wherein during said tennis play, the tennis player holds a tennis racket with at least one arm of said tennis player;

placing the covered first knee of the player on a tennis court surface during tennis play., with said knee pad positioned between the first knee and said surface, wherein during said placing step, said second knee is kept out of contact with and above said tennis court surface; and wherein the tennis racket is swung by the tennis player toward a tennis ball so as to execute a forehand stroke and hit said tennis ball with the said racket during tennis play, wherein said ball is hit with said racket at a time period selected from the group consisting of while said covered first knee is on said tennis court surface, and during said placing step but prior to the covered first knee contacting the tennis court surface.

2. The method of claim 1 wherein the covering step is carried out only on said first knee of said player, wherein said second knee remains uncovered during said tennis play.

3. The method of claim 2 wherein said covering step is selected from the group consisting of covering a right knee of a right-handed player, and covering a left knee of left-handed player.

4. The method of claim 1 wherein the ball is hit while the first knee is on said surface.

5. The method of claim 3 wherein the ball is hit when the covered first knee is on said tennis court surface.

6. The method of claim 5 wherein a torso portion of the player is substantially upright with respect to said tennis court surface when said ball is hit.

7. The method of claim 5 wherein said ball is hit when said covered first knee and said two feet are contacting the tennis court surface, and when said second knee is out of contact with and above said tennis court surface.

8. The method of claim 1 wherein said ball is hit when said two feet are contacting the tennis court surface, said second knee is out of contact with and above said tennis court surface, and during said placing step but prior to the covered first knee contacting the tennis court surface.

9. A method of using a tennis racket during tennis play so as to execute a tennis backhand stroke, comprising:

covering a first knee of a tennis player with a knee pad during tennis play, said tennis player having a second knee and two feet, wherein during said tennis play, the tennis player holds a tennis racket with at least one arm of said tennis player;

placing the covered first knee of the player on a tennis court surface during tennis play, with said knee pad positioned between the first knee and said surface, wherein during said placing step, said second knee is kept out of contact with and above said tennis court surface; and wherein the tennis racket is swung by the tennis player toward a tennis ball so as to execute a backhand stroke and hit said tennis ball with the said racket during tennis play, wherein said ball is hit with said racket at a time period selected from the group consisting of while said covered first knee is on said tennis court surface, and during said placing step but prior to the covered first knee contacting the tennis court surface.

10. The method of claim 9 wherein the covering step is carried out only on said first knee of said player, wherein said second knee remains uncovered during said tennis play.

11. The method of claim 10 wherein said covering step is selected from the group consisting of covering a right knee of a right-handed player, and covering a left knee of a left-handed player.

12. The method of claim 9 wherein the ball is hit while the first knee is on said surface.

13. The method of claim 11 wherein the ball is hit when the covered first knee is on said tennis court surface.

14. The method of claim 13 wherein a torso portion of the player is substantially upright with respect to said tennis court surface when said ball is hit.

15. The method of claim 13 wherein said ball is hit when said covered first knee and said two feet are contacting the tennis court surface, and when said second knee is out of contact with and above said tennis court surface.

16. The method of claim 9 wherein said ball is hit when said two feet are contacting the tennis court surface, when said second knee is out of contact with and above said tennis court surface, and during said placing step but prior to the covered first knee contacting the tennis court surface.

* * * * *